US006407325B2

(12) United States Patent
Yi et al.

(10) Patent No.: US 6,407,325 B2
(45) Date of Patent: Jun. 18, 2002

(54) BACKGROUND MUSIC PLAY DEVICE AND METHOD THEREOF FOR MOBILE STATION

(75) Inventors: Sang Yong Yi; Du Hyun Yoon, both of Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/748,224

(22) Filed: Dec. 27, 2000

(30) Foreign Application Priority Data

Dec. 28, 1999 (KR) ..... 99-63824
Apr. 11, 2000 (KR) ..... 00-19017

(51) Int. Cl.[7] ..... G10H 1/36; G10H 7/00
(52) U.S. Cl. ..... 84/610; 84/600; 84/634; 84/645
(58) Field of Search ..... 84/600–602, 615–616, 84/618, 634, 645, 653–654, 656, 666; 379/185, 374

(56) References Cited

U.S. PATENT DOCUMENTS 5,459,702 A * 10/1995 Greenspan ..... 369/25
5,912,958 A * 6/1999 Eyran et al. ..... 379/170
5,963,624 A * 10/1999 Pope ..... 379/110.01
6,084,168 A * 7/2000 Sitrick ..... 84/477 R
6,167,251 A * 12/2000 Segal et al. ..... 455/406
6,192,253 B1 * 2/2001 Charlier et al. ..... 455/550
6,192,340 B1 * 2/2001 Abecassis ..... 704/270

* cited by examiner

*Primary Examiner*—Marlon T. Fletcher
(74) *Attorney, Agent, or Firm*—Fleshner & Kim, LLP

(57) ABSTRACT

The present invention provides a background music play device equipped in a mobile station and methods for playing the background music capable of playing the background music during voice communication between two mobile stations. A background music play device for a mobile station of the present invention includes storage means for storing digital music file; music file play means for playing the digital music file stored in the storage means; output means for outputting voice of caller and music played by the music file play means; input means for inputting voice of receiver; control means which control signal transmittance and receipt, encoding signals to be transmitted and decoding signals received, and outputting the music as a background music according to user's selection. Using the mobile station equipped with the background music play device, specific background music is preset relative to each phone number set in the mobile station such that the preset background music is automatically played when a communication channel is established with the mobile station having one of the preset phone numbers.

52 Claims, 3 Drawing Sheets

BACKGROUND MUSIC PLAY DEVICE AND METHOD THEREOF FOR MOBILE STATION

BACKGROUND OF THE INVENTION (a) Field of the Invention

The present invention relates to a mobile station, and in particular, to a background music play device and method for the mobile station capable of playing background music during voice communication with a counterpart mobile station.

(b) Description of the Conventional Art

As shown in FIG. 1, a mobile station comprises an antenna 101 for receiving and transmitting radio frequency (RF) signals, an RF processing part 102 for converting incoming analog signals into digital signals using an analog-to-digital converter (ADC) and for converting outgoing digital signals into analog signals using a digital-to-analog converter (DAC), a mobile station modem (MSM) 103 for controlling the mobile station, a coder-decoder (CODEC) 104 for coding and decoding digital signals, a speaker 105, and ear phone jack 106 for outputting voice, and a microphone for inputting user's voice.

The outgoing data processes are as follows.

Once the user's voice having a bandwidth of 300 Hz~3.4 kHz is inputted through the microphone 107, it is processed by a sampling process and digitalized in the CODEC 104 using a pulse code modulation. The modulated signal is then sent to the MSM 103. Consequently, the MSM 103 encodes the modulated signals using the Qualcomm Codebook Exited Linear Prediction (QCELP) algorithm in various data rate of 8 kbps and 13 kbps, and then sends the data to the RF processing part 102. The RF processing part 102 takes the data from the MSM 103 on a carrier wave so as to transmit into air using a Code Division Multiple Access (CDMA) technology.

As explained above, the incoming signals are decoded in reverse order of the outgoing signal processes so as to be heard through the speaker 105 and earphone 106 by a counter part mobile station.

However, this conventional mobile station has only the voice communication function such that if the user wants to stop the communication during some period due to an indispensable situation, the counterpart user may become bored without conversation. Even when the two users communicate with each other, they can feel monotonous during their conversation.

Recently, as the mobile communication is abruptly widespread and the mobile station has become a necessity of life, mobile stations have added additional functions. Besides the voice communication function, other functions such as a short message service, data storage function, special information services of weather and stock market information and so on, and internet access and web search are integrated into the mobile station.

Furthermore, as multimedia compression technologies such as the Moving Picture Experts Group (MPEG) are getting highly developed and the memory chips are getting smaller in size, it is possible to store large data into the mobile station and to transfer the data to other mobile station or computer system in high speed data rate in the near future. For example, many kinds of software programs that can play an MP3 audio file, which adapts the MPEG technology to audio compression, have been spread all around world, and portable MP3 players are replacing conventional cassette recorders.

SUMMARY OF THE INVENTION

The present invention has been made in an effort to integrating an MP3 storage and player into the mobile station so as to play the stored MP3 files as background music during voice conversation.

The mobile station of the present invention comprises storage means for storing music data, control means for controlling so as to play the music data, and music data processing means for processing the music data under control of the play control means.

It is an object of the present invention to provide a background music play device and method thereof for a mobile station, which is capable of playing background music during voice communication between two mobile stations.

It is another object of the present invention to provide a background music play device and a method thereof capable of playing the background music in such a way that the background music can be listened through the mobile station equipped with the background music play device without transmitting the background music to a counterpart mobile station.

It is still another object of the present invention to provide a background music play device and method thereof capable of playing the background music in such a way that the background music is transmitted to the counterpart mobile station such that the background music can be listened through both mobile stations during the voice communication.

It is still another object of the present invention to provide a background music play device and method thereof capable of stopping the playing of background music when a communication channel is established and resuming the background music from the point where the music was stopped after the voice communication channel is released according to a user's selection.

Finally, it is another object of the present invention to provide a background music play device and method thereof capable of presetting the background music in relation to preset phone numbers such that preset background music is automatically played when a communication channel establishment is made with a counterpart mobile station having one of the preset phone numbers.

To achieve the above objects, the background music play device of the present invention comprises storage means for storing digital music file, music file play means for playing the digital music file stored in the storage means, output means for outputting voice of caller and music played by the music file play means, input means for inputting voice of receiver, control means which control signal transmittance and receipt, encoding signals to be transmitted and decoding signals received, and outputting the music as a background music according to user's selection.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will be described hereinafter with reference to the accompanying drawings.

Figure 1:
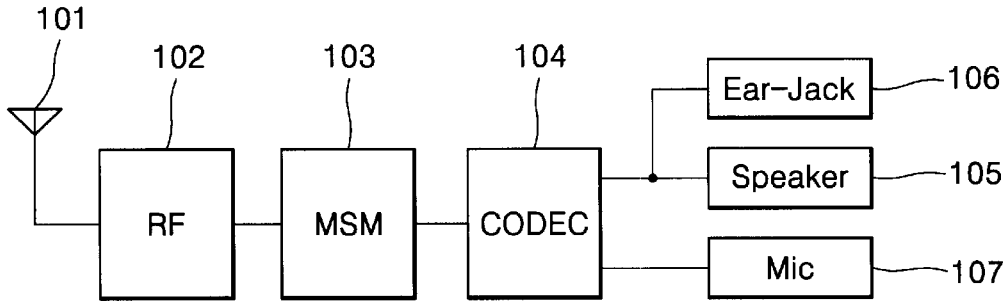
FIG. 1 is a block diagram for illustrating a structure of conventional mobile station.
Figure 2:
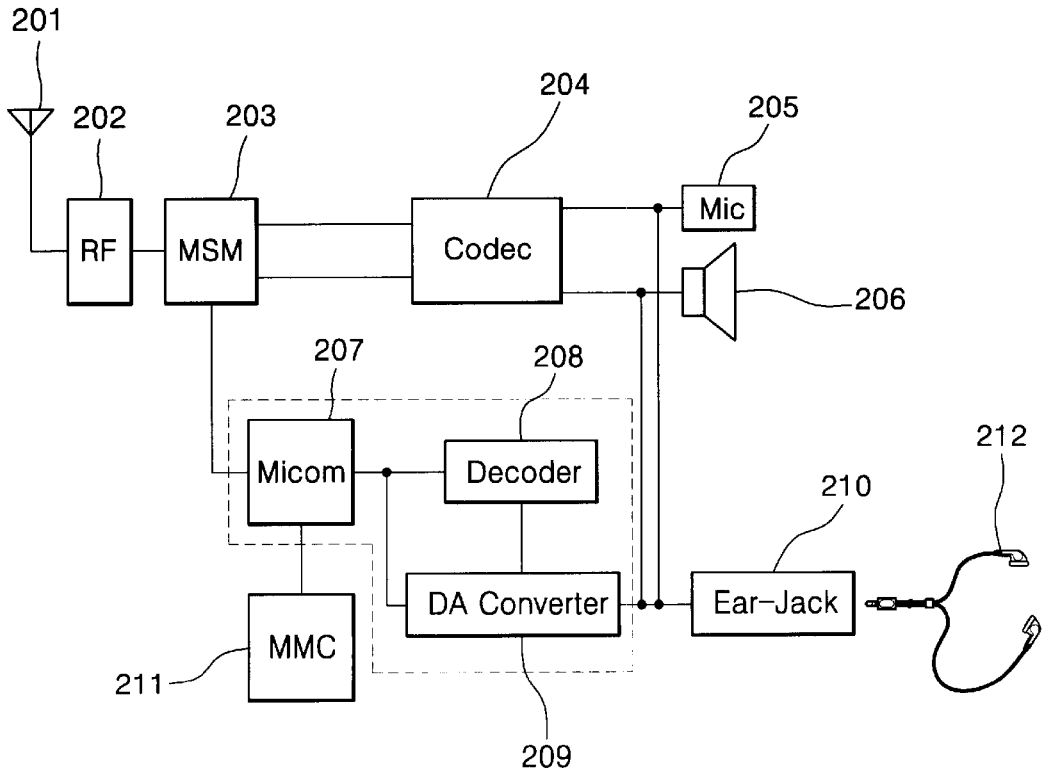
FIG. 2 is block diagram for illustrating a structure of a mobile station integrated with a background music play device according to the present invention.

FIG. 2 is block diagram for illustrating a mobile station integrated with a background music play device according to the present invention.

In FIG. 2, the mobile station of the present invention comprises an antenna 201 for receiving and transmitting RF signals, RF processing part 202 for processing the signals received and to be transmitted, a MSM 203 for controlling voice coding, channel coding, and power control of the mobile station, a microphone 205 for inputting voice, a speaker 206 for outputting voice, a CODEC 204 for coding analog signals into digital signals and decoding the digitals into analog signal, a multimedia card (MMC) 211 for storing MP3 data, a microcomputer 207 for controlling manipulation of the MP3 data, a decoder 208 for decoding the MP3 data into digital audio signals, a D/A converter 209 for converting the decoded digital audio signals into analog audio signals, and an ear-jack 210 for securing an earphone 212 so as to output the analog audio signals.

The ear-jack 210 is separately provided for listening to the MP3 music such that it differs from a jack for voice communication. Generally, the voice communication jack is electrically connected to the microphone 205 and the speak 206 for the voice communication.

The background music play operation of the above structured mobile station will be described with referenced to FIG. 2 hereinafter.

When the music play function is desired, the function is activated by selecting "on" in a background music manual window by button manipulation in state of the multimedia card 211 being installed into the mobile station. After the function is activated, if a music data file stored in the multimedia card 211 is selected, the microcomputer 207 reads the selected music file and sends the same to the decoder 208 such that the music file is decoded into digital audio signals by the decoder 208. The digital audio signals are then sent to the D/A converter 209. The D/A converter 209 converts the digital audio signals from the decoder 208 into analog audio signals so as to send the converted analog audio signals to the CODEC 204, the speaker 206, and the ear-jack 210.

The CODEC 204 mixes the analog audio signals from the D/A converter 209 with voice signals input through the microphone 206, samples the mixed signal, and converts the mixed signal into PCM data. The PCM data is transmitted to the MSM 203 such that the MSM 203 encodes the PCM data using the QCELP algorithm and sends the coded data to the RF processing part 202 at a data rate of 8 kbps or 13 kbps. The RF processing part 202 converts the data from the MSM 203 into analog signals and then transmits the signals in forms of CDMA frames into the air through the antenna 201. The RF signals is received by an expected mobile station, decoded, and demodulated in the reverse order of the transmission processes such that it is possible for the counterpart user to listen to the voice and music at the same time through the speaker 206 and the ear-jack 210.

During these processes, the background music signals from the D/A converter 209 can be outputted through the speaker 206 or the ear-jack 210 of the mobile station.

A method of playing background music according to a first preferred embodiment of the present invention will be described hereinafter.

The background music play method of the mobile station of the present invention comprises the steps of determining whether the music is stopped or not when a communication channel will be established with another mobile station when the music is being played, communicating while music is playing if it is determined to continue playing the music, and communicating without the background music if it is determined to stop playing the music.

Figure 3:
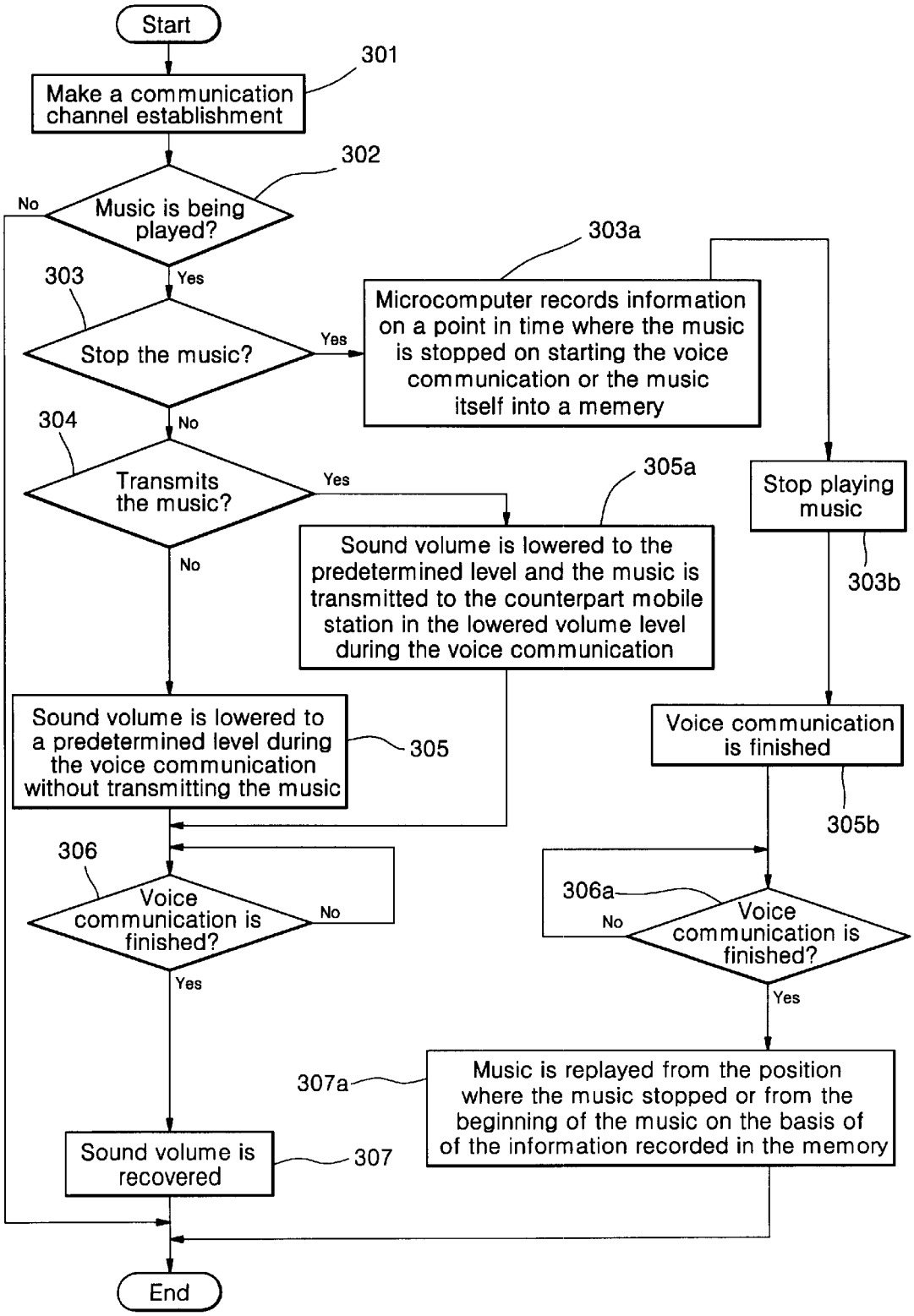
FIG. 3 is a flow chart for illustrating a method for controlling background music play device of FIG. 2 according to a first preferred embodiment of the present invention.

FIG. 3 is a flow chart for illustrating a method for controlling background music play device according to a first preferred embodiment of the present invention.

As shown in FIG. 3, once the mobile station equipped with the background music play device is requested to establish a communication channel at step 301, the microcomputer 207 determines if music is being played or not at step 302. If no music is being played, a normal communication channel establishment process is performed. If music is being played, it is determined whether to stop the music during the voice communication according to the user's button manipulation or a preset algorithm at step 303.

If it is determined to continuously play music during the voice communication, it is next determined whether the mobile station should transmit the music to the counterpart mobile station together with the voice at step 304. In music play mode, the determination of whether the music should be transmitted or not can be determined automatically or by the button manipulation.

If it is determined not to transmit the music, sound volume is lowered to a predetermined level during the voice communication without transmitting the music at step 305. While, if it is determined to transmit the music to the counterpart mobile station, the sound volume is lowered to the predetermined level and the music is transmitted to the counterpart mobile station in the lowered volume level during the voice communication at step 305*a*.

Consequently, it is determined whether the voice communication is finished at step 306, and the sound volume is recovered if the voice communication is finished at step 307.

At step 303, if it is determined to stop playing music, the microcomputer 207 records information on a point in time where the music is stopped when the voice communication begins, or the music itself into a memory at step 303*a,* and then stop playing music at step 303*b.* Consequently, the voice communication continues without playing music at step 305*b.* It is then determined whether the voice communication has finished or not at step 306*a.* If the voice communication has finished, the music is restarted from the position where the music stopped or from the beginning of the music on the basis of the information recorded in the memory at step 307*a.*

At step 303*a,* it is preferred that the point where the music is stopped is the time when the phone rings.

In this way, it is possible to have a conversation while listening to the background music.

The background music playing method according to a second preferred embodiment of the present invention will be described with reference to FIG. 4 hereinafter.

In the second preferred embodiment of the present invention, the background music play device can be set in such a way that the background music is played only when communicating with a mobile station having one of preset phone numbers.

The background music playing method of the second preferred embodiment of the present invention comprises the steps of setting specific phone numbers for playing the background music only when communicating with the mobile station having one of the preset phone numbers, determining if the phone number of a counterpart mobile station is one of the preset numbers for playing the background music, performing voice communication while transmitting the background music to the counterpart mobile station if the number of the counterpart mobile station is one of the preset numbers.

Figure 4:
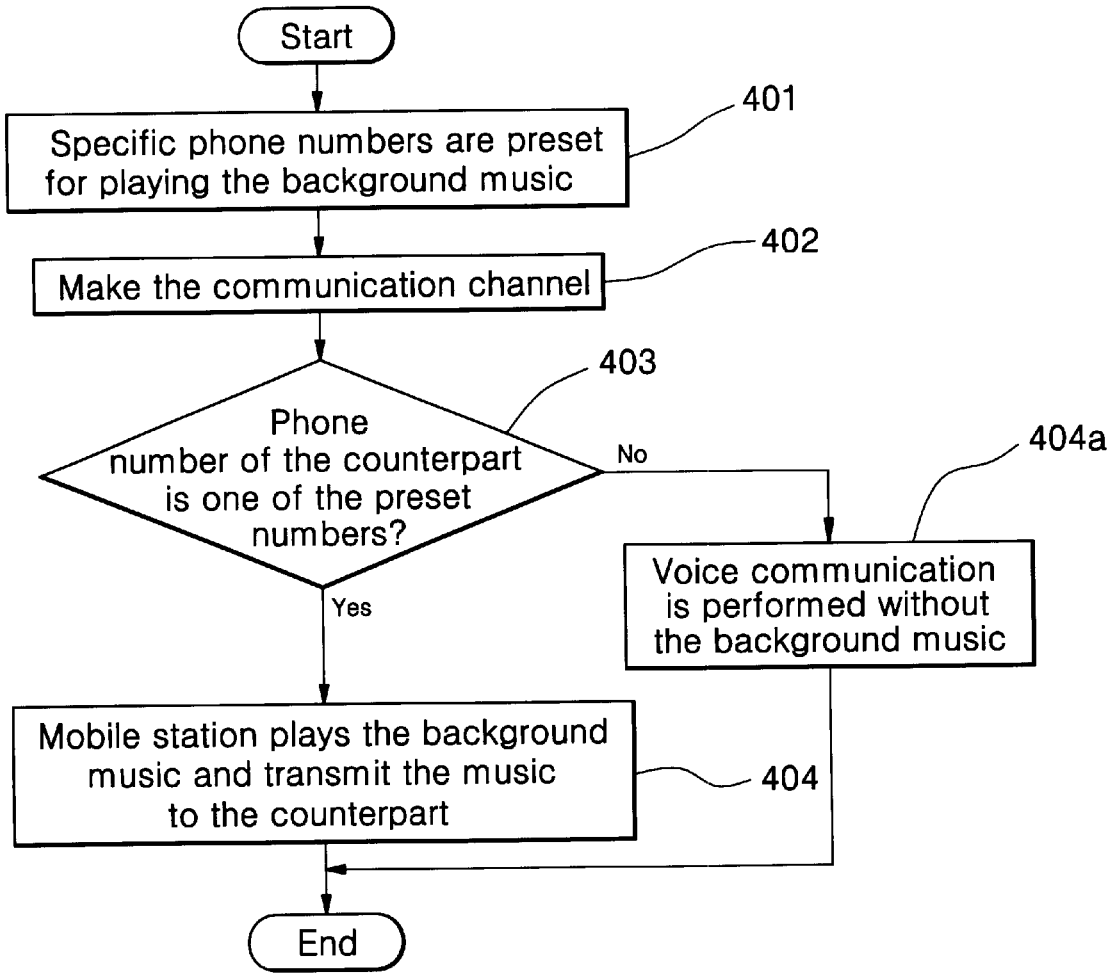
FIG. 4 is a flow chart for illustrating another method for controlling background music play device of FIG. 2 according to a second preferred embodiment of the present invention.

FIG. 4 is a flow chart for illustrating a background music play method according to another preferred embodiment of the present invention.

Firstly, specific phone numbers are preset for playing the background music only when the mobile station is requested to make a communication channel with the mobile station having one of the preset phone numbers at step 401. After the preset is finished, if the mobile station is requested to make the communication channel at step 402, it is determined if the phone number of the counterpart is one of the preset numbers at step 403. If it is determined that the number of the counterpart is not one of the preset numbers, the voice communication is performed without the background music at step 404*a*. While, if it is determined that the number of the counterpart is one of the preset numbers at step 403, the mobile station plays the background music and transmit the music to the counterpart at step 404.

The background music play device can be installed to and uninstalled from the mobile station and can download and play music files provided by service providers.

Also, the music can be selectively played among the music files stored in the memory, and the background music can be automatically selected according to the phone number of the counterpart user. As explained above, the background music can be selectively played according to the phone numbers when the mobile station required to establish a communication channel and the background music can be selected among the music files stored in the memory by the user, and the background music can be randomly selected according to the phone number of channel establishment requester. Also it is possible to set so as to select and play a music file as a background music during the voice communication when the input number for requesting the communication channel establishment is one of the preset numbers. The point to begin playing the background music is when the communication channel is established.

As described above, in the mobile station equipped with the background play device, the background music can be heard during the voice communication by the two communicators such that the background music helps the conversation to be smooth and comfortable, resulting in enhancing communication quality. Also, since the background music play method for mobile station of the present invention can play background music automatically, it is possible to have a conversation while the music is being played, and keep playing music after the communication channel is released. It can thus satisfy the various user requirements.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A music play device for a mobile communication terminal, comprising:

storage means for storing at least one digital music file in a mobile communication terminal;

music file play means for playing the at least one digital music file stored in the storage means;

output means for outputting a voice of a counterpart user and music played by the music file play means;

input means for inputting a voice of a user of the mobile communication terminal; and control means which controls signal transmission and reception, encodes signals to be transmitted and decodes signals received, and outputs the music according to the user's selection, wherein the music file play means is capable of playing the at least one digital music file stored in the storage means during voice communications between the user and the counterpart user.

2. The device of claim 1, wherein the control means outputs the music through the output means of the mobile communication terminal.

3. The device of claim 1, wherein the control means transmits the music to a counterpart user together with the user's voice such that the user and the counterpart user listen to the music during voice communication.

4. The device of claim 1, wherein the storage means is a card type storage.

5. The device of claim 1, wherein the output means is at least one of a speaker and an ear-jack.

6. The device of claim 1, wherein the music file play means comprises a decoding means for decoding music data into digital signals, a D/A converter for converting the decoded digital signals into analog signals, and a microcomputer for controlling the music file play means and the D/A converter.

7. The device of claim 1, wherein the music file is formatted in MP3 compression.

8. The device of claim 1, wherein a sound volume of the music outputted by the output means is adjusted from an initial level to a prescribed level when a call is connected between the user and the counterpart user, and wherein the sound volume is readjusted to the initial level when the call connection is terminated.

9. The device of claim 1, wherein if the music file play means is playing the at least one digital music file, the music file play means pauses the playing of the at least one digital music file when a call is connected between the user and the counterpart user, and resumes the playing of the least one digital music file when the call connection is terminated.

10. The device of claim 9, wherein a time location indicating a point in time at which the file play means pauses the playing is stored such that the file play means can resume the playing at the point of pause when the call connection is terminated.

11. The device of claim 1, wherein the music file is audible to each of the user and the counterpart user.

12. The device of claim 1, wherein the music file is transmitted from the user's mobile communication terminal to the counterpart user's mobile communication terminal in MP3 format.

13. The device of claim 1, wherein the music file play means comprises a microprocessor coupled to receive an input from the control means and the storage means and configured to provide a formatted data output, a decoder coupled to receive the formatted data from a microprocessor and to decode the formatted data into a digital audio signal, and a digital to analog converter coupled to receive the digital audio signal and convert it to an analog output signal and provide the analog output signal to the output means.

14. The device of claim 1, wherein the storage means comprises a multimedia card configured to store MP3 file data.

15. The device of claim 1, wherein the storage means further stores at least one phone number to automatically play music when communicating with a counterpart user having the at least one phone number.

16. A method of playing music in a mobile communication terminal equipped with a music play device, comprising:

determining whether a mobile communication terminal is playing music through a music play device;

determining whether to stop playing music when voice communication is initialized if it is determined that music is playing;

performing voice communication with a counterpart user while the music is being played if it is determined not to stop playing music when the voice communication is initialized, a sound volume of the music being lowered to a prescribed level during the voice communication and being recovered after the voice communication finishes; and performing voice communication with the counterpart user without playing music if it is determined to stop playing music when the voice communication is initialized.

17. The method of claim 16, wherein the music is transmitted to the counterpart user such that the counterpart user can hear the music during the voice communication.

18. The method of claim 16, wherein if it is determined to stop playing music, a point in time when the music pauses on starting voice communication is recorded.

19. The method of claim 18, wherein a start point of the voice communication is when the mobile station rings.

20. The method of claim 16, wherein if it is determined to stop playing music, a point in time when the music pauses on starting voice communication is recorded and the music is replayed from the recorded point after the voice communication finishes.

21. The method of claim 16, further comprising determining whether to initiate playing music if it is determined that music is not playing through the music play device, and performing voice communication with a counterpart while music is being played if it is determined that music playing is to be initiated.

22. The method of claim 16, wherein the music is transmitted to the counterpart user such that the counterpart user can hear the music during the voice communication if it is determined not to stop playing music when the voice communication is initialized.

23. The method of claim 16, wherein the determination of whether to stop playing music when voice communication is initialized is based on at least one of an identification of a telephone number of an incoming call and the dialed telephone number of an outgoing call.

24. The method of claim 23, further comprising storing at least one phone number to automatically determine to play music when communicating with a counterpart user having the at least one phone number.

25. A method of playing music in a mobile station equipped with a music play device, comprising:

presetting at least one phone number for automatically playing background music when communicating with a counterpart user having one of the at least one preset phone numbers;

determining if the counterpart mobile station has one of the at least one phone number;

playing and transmitting background music during voice communication if it is determined the counterpart user has one of the at least one phone number.

26. The method of claim 25, wherein phone numbers are preset in relation to specific background music to be played during the voice communication such that the preset music is played and transmitted to the counterpart user when the number is selected to establish a voice communication channel.

27. The method of claim 26, wherein the background music is preset for each phone number.

28. The method of claim 26, wherein the background music to be played is determined by comparing a received phone number to the preset phone numbers.

29. Method of claim 26, wherein the background music to be played is determined by comparing a number entered by the user to the preset phone numbers.

30. The method of claim 26, wherein the background music is played on the communication channel being established.

31. A mobile communication terminal, comprising:

a radio frequency (RF) processor coupled to receive RF signals through an antenna;

a controller coupled to receive an output of the RF processor and control voice coding, channel coding, and power of the communication terminal;

a coder/decoder (CODEC) coupled to the controller and configured to provide analog voice data as an output;

a memory device coupled to the controller to store MP3 data;

a microprocessor coupled between the controller and the memory, and configured to process MP3 data; and a signal processor coupled to receive MP3 data from the processor and output analog audio signals, wherein the output of the CODEC and the output of the signal processor are configured to be combined at an option of a user, wherein the analog audio signals can be outputted while a communication channel is open between the mobile communication terminal and a receiving terminal.

32. The device of claim 31, wherein the controller comprises a mobile station modem (MSM).

33. The device of claim 31, wherein the signal processor comprises:

a decoder coupled to receive MP3 data and decode the MP3 data into digital audio signals; and a digital to analog converter coupled to receive the digital audio signals and generate analog audio signals.

34. The device of claim 31, wherein MP3 data is received as an RP signal through the antenna.

35. The device of claim 31, wherein the memory circuit comprises a multimedia card.

36. The device of claim 31, further comprising a first audio jack coupled to receive the output analog audio signals, and configured to receive at least one of an earphone plug and a headphone plug.

37. The device of claim 36, further comprising a second audio jack configured to receive a voice output from the mobile communication terminal.

38. The device of claim 31, wherein MP3 data can be transmitted from the memory device through the RF processor and the antenna to a counterpart user.

39. The device of claim 31, wherein the analog audio signals are transmitted to the receiving terminal while the communication channel is open.

40. The device of claim 31, further comprising an output device configured to receive and audibly output the voice signals, wherein a sound volume of the audibly outputted signals by the output device is adjusted from an initial level to a prescribed level when a call is connected between a user and a counterpart user, and wherein the sound volume is readjusted to the initial level when the call connection is terminated.

41. A mobile communication terminal, comprising:

a radio frequency (RF) processor, coupled to receive RF signals through an antenna;

a controller coupled to receive an output of the RF processor and control voice coding, channel coding, and power of the communication terminal;

a processor coupled to the controller and configured to manipulate Moving Pictures Experts Group (MPEG) formatted data;

a memory device coupled to the processor to store MPEG data; and a signal processor coupled to receive MPEG data from the processor and output decoded signals to a monitoring device, wherein a voice call can be connected between a user and a counterpart user while decoded signals are outputted to the monitoring device, wherein a determination is made as to whether to stop outputting decoded signals to the monitoring device when voice communication is initialized, and wherein the determination is based on at least one of an identification of a telephone number of an incoming call and the dialed telephone number of an outgoing call.

42. The device of claim 41, wherein the MPEG data is MP3 data.

43. The device of claim 41, wherein the decoded output signals comprise analog audio signals.

44. The device of claim 41, wherein the signal processor comprises:

a decoder coupled to receive MPEG data and decode the MPEG data into digital audio signals; and a digital to analog converter coupled to receive the digital audio signals and generate analog audio signals.

45. The device of claim 41, further comprising storing at least one phone number to automatically determine to continue outputting decoded signals when communicating with a counterpart user having the at least one phone number.

46. The device of claim 41, wherein when a voice call is connected between a user and a counterpart user while decoded signals are outputted to the monitoring device, and audio level of the decoded signal is reduce during the voice call.

47. A method of playing music in a mobile communication terminal equipped with a music playing device, comprising:

determining whether a mobile communication terminal is playing music through a music playing device;

determining whether to stop playing music when voice communication is initialized if it is determined that music is playing;

performing voice communication with a counterpart user while the music is being played if it is determined not to stop playing music when the voice communication is initialized; and performing voice communication with the counterpart user without playing music if it is determined to stop playing music when the voice communication is initialized.

48. The method of claim 47, further comprising determining whether to initiate playing music if it is determined that music is not playing through the music play device, and performing voice communication with a counterpart while music is being played if it is determined that music playing is to be initiated.

49. The method of claim 48, wherein the determination of whether to initiate playing music when voice communication is initialized is based on at least one of an identification of a telephone number of an incoming call and the dialed telephone number of an outgoing call.

50. The method of claim 47, wherein the music is transmitted to the counterpart user such that the counterpart user can hear the music during the voice communication if it is determined not to stop playing music when the voice communication is initialized.

51. The method of claim 47, wherein the determination of whether to stop playing music when voice communication is initialized is based on at least one of an identification of a telephone number of an incoming call and the dialed telephone number of an outgoing call.

52. The method of claim 51, further comprising storing at least one phone number to automatically determine to play music when communicating with a counterpart user having the at least one phone number.

* * * * *